United States Patent [19]

Ziegler et al.

[11] Patent Number: 4,563,984

[45] Date of Patent: Jan. 14, 1986

[54] SUCTION PIPE APPARATUS FOR AN INTERNAL-COMBUSTION ENGINE

[75] Inventors: Gerhard Ziegler, Besigheim; Karl Gregotsch, Heimerdingen; Rolf von Sivers, Rutesheim, all of Fed. Rep. of Germany

[73] Assignee: Dr. Ing. h.c.F. Porsche Aktiengesellschaft, Weissach, Fed. Rep. of Germany

[21] Appl. No.: 652,513

[22] Filed: Sep. 20, 1984

[30] Foreign Application Priority Data

Sep. 20, 1983 [DE] Fed. Rep. of Germany ..... 3333843

[51] Int. Cl.[4] ..... F02M 61/14

[52] U.S. Cl. ..... 123/52 M; 123/470

[58] Field of Search ..... 123/52 M, 470–472

[56] References Cited

U.S. PATENT DOCUMENTS

| | | | |
|---|---|---|---|
| 3,941,109 | 3/1976 | Schmid | 123/470 |
| 4,111,163 | 9/1978 | Ederer et al. | 123/52 M |
| 4,254,746 | 3/1981 | Chiba et al. | 123/52 M |
| 4,492,201 | 1/1985 | Radaelli | 123/470 |

FOREIGN PATENT DOCUMENTS

| | | |
|---|---|---|
| 1156276 | 4/1964 | Fed. Rep. of Germany . |
| 2824205 | 12/1979 | Fed. Rep. of Germany . |
| 2835807 | 2/1980 | Fed. Rep. of Germany . |
| 107062 | 8/1980 | Japan . |

*Primary Examiner*—Craig R. Feinberg

*Attorney, Agent, or Firm*—Barnes & Thornburg

[57] ABSTRACT

A suction pipe apparatus for an internal-combustion engine with fuel injection, especially intermittent fuel injection into intake pipes connected to the cylinder head of the engine. The intake pipes are connected to the cylinder head by a flanged, structure-borne-noise-insulating connecting pipe made from an elastomer. A sleeve-shaped portion for receiving a fuel injection valve is also provided at the connecting pipe. The sleeve-like portion encapsulates the valve to reduce noise emissions. The flange of the connecting pipe is provided with a reinforcing member to enhance the integrity and durability of the connection.

4 Claims, 1 Drawing Figure

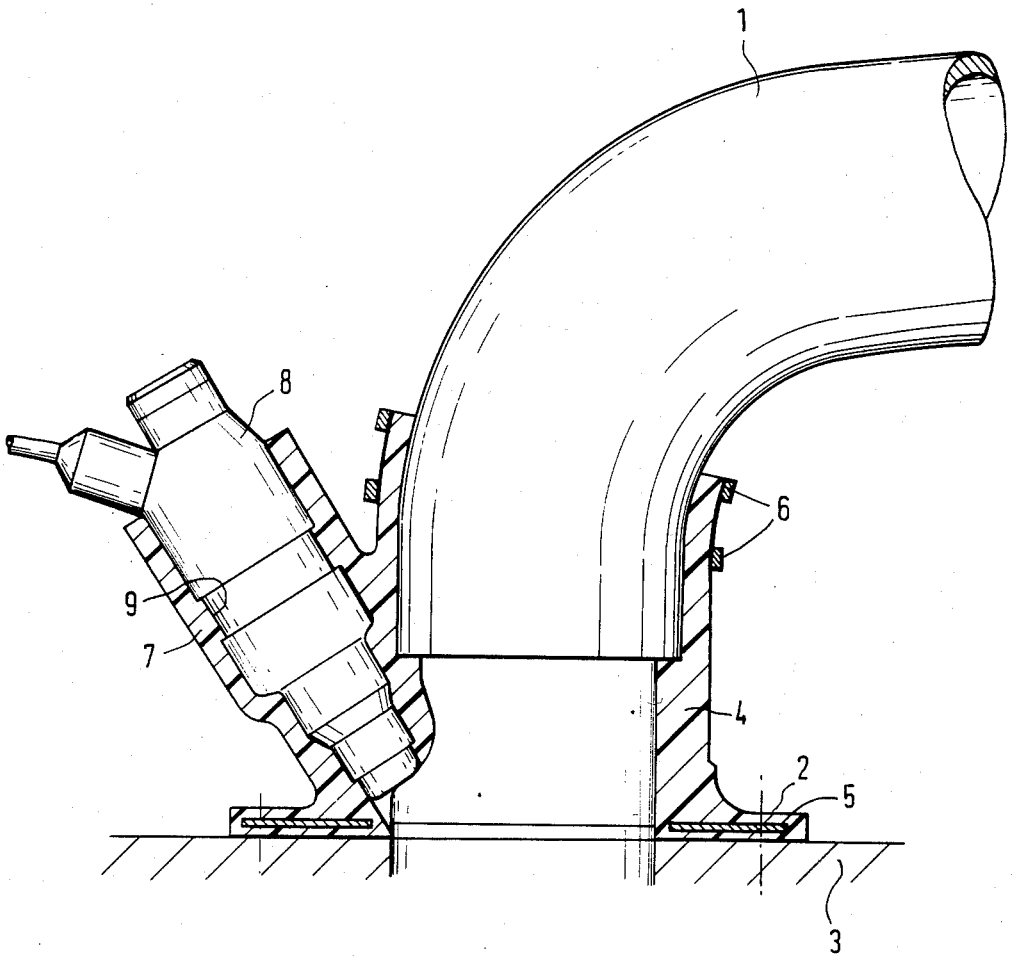
1
8
6
9
7
4
2
5
3

SUCTION PIPE APPARATUS FOR AN INTERNAL-COMBUSTION ENGINE

BACKGROUND AND SUMMARY OF THE INVENTION

This invention relates generally to a suction pipe apparatus for an internal-combustion engine and, more particularly, to a suction pipe apparatus for an internal-combustion engine which is provided with a fuel injection system for intermittently injecting fuel into the intake pipes connected to the engine cylinder head.

In an internal-combustion engine, one of the components having one of the highest levels of structure-borne noise (i.e., noise transmitted through and by the structural components of the engine) is the cylinder head. The cylinder head is subjected to noise vibrations produced by combustion and by operation of the intake air control apparatus. If transmitted to the suction or intake pipes, these high structure-borne noise levels can result in production of considerable levels of reflected noise, due to the relatively large surface area of the intake pipes. In the case of engines with intermittent fuel injection, high frequency pulse-like ticking sounds are superimposed on these noises at low speeds. The ticking sounds are reflected, in part, by the cylinder head, the suction pipes and the fuel collector pipe, and, in part, directly by the surface of the fuel injection valves. With each reduction in the levels of engine noises from other sources, these ticking sounds become more noticable and disturbing.

German Unexamined Published Application (DE-OS) No. 28 24 205 and German Examined Published Application (DE-AS) No. 11 56 276 show the use of elastic flange elements to connect the intake pipes to the cylinder head. The purpose of these elements is to decouple the cylinder head vibrations from the intake pipes, thus provided a degree of insulation with respect to structure-borne noises. However, in these cases, the elastic flange element shown does not provide for a durable connection of the intake pipe to the cylinder head, and measures for reducing the ticking noises produced by the fuel injection valves are not provided.

It is an objective of this invention to provide a suction pipe apparatus for an internal-combustion engine of the above-noted type which includes a durable, secure and highly stable structure for fastening the suction pipe to the cylinder head and which, in addition, provides for a reduction in the noise produced by the fuel injection valves.

This objective is attained in a suction pipe apparatus which comprises a structure-borne-noise-insulating connecting pipe arranged between the cylinder head and the intake pipe. The connecting pipe is provided with a sleeve-like portion for receiving a fuel injection valve. The inner surface of the sleeve-like portion conforms to the shape of the fuel injection valve, allowing the portion to tightly enclose the outer, noise-reflecting surface of the valve. The connecting pipe and sleeve-shaped portion are formed from an elastomer, such as a thermoplastic material. In a preferred embodiment; the connecting pipe and the sleeve-shaped portion are integrally formed to provide a unitary structure. In an especially preferred embodiment, a flange portion of the connecting pipe is provided with a stiffening member to enhance the strength and durability of the suction pipe/cylinder head connection. The elastomeric connecting pipe may be clamped to the intake pipe or, in an alternative and advantageous embodiment, integrally formed onto the intake pipe by known techniques of injection molding.

The primary advantage achieved by means of this invention is a reduction in the level of engine noise emissions. The suction pipe apparatus of the present invention provides effective insulation of the suction pipes from the cylinder head, with respect to structure-borne noise, reducing the level of subsequently reflected sounds. In addition, the pipe apparatus provides for the structure-borne-noise-insulating and encapsulating of the fuel injection valves. Consequently, high-frequency pulse-like ticking noises are prevented. The encapsulating enclosure provides for absorption of air-borne noise and insulation of the fuel injectors and suction pipes from structure-borne noises of the cylinder head. The elastomer sleeve which tightly encloses the fuel injectors also provides for damping of structure-borne noises.

Further objects, features, and advantages of the present invention will become more apparent from the following description when taken with the accompanying drawing which show, for purposes of illustration only, embodiments in accordance with the present invention.

BRIEF DESCRIPTION OF THE DRAWING

An embodiment of an air intake pipe having an elastomeric connecting pipe with an integral fuel injection valve-receiving sleeve according to the present invention is shown in the drawing.

DETAILED DESCRIPTION OF THE DRAWING

A suction pipe system for an internal-combustion engine has several intake pipes 1, each of which are connected to a cylinder head 3 of the internal-combustion engine by a flanged member. In the single figure, structure-borne-noise-insulating connecting pipe 4 is provided between the cylinder head 3 and the individual intake pipe 1. Connecting pipe 4 is formed from an elastic material, preferably an elastomer.

A flange 2, made from the same material as connecting pipe 4 is used for connecting the pipe to cylinder head 3. Flange 2 is reinforced by stiffening member 5 made of steel or an equivalent material. Molded bushes may also be provided in the flange.

The connection of elastic connecting pipe 4 with metallic intake pipe 1 takes place either by clamping rings 6, as shown, or by molding pipe 4 onto the intake pipe by means of a known injection molding process.

A sleeve-shaped receiving means 7 for an injection valve 8 is provided in the elastic connecting pipe 4. Receiving means 7 is formed integrally with connecting pipe 4 and provides an encapsulating receiver for fuel injection valve 8. For this purpose, receiving means 7 corresponds to the length of the valve as far as is possible. Inner surface 9 of receiving means 7 conforms to the shape of fuel injection valve 8 to provide for a form-fitting fastening of the valve. Receiving means 7 is designed in such a way as to tightly enclose the valve and to cover the noise-reflecting surface of the valve to reduce overall engine noise emissions.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Suction pipe apparatus for internal-combustion engine having fuel injection, especially intermittent fuel injection into an intake pipe connected to a cylinder head of the engine, comprising a one-piece structure-borne-noise insulating connecting pipe formed of a vibration attenuating material being arranged between the cylinder head and the intake pipe, said connecting pipe having sleeve-shaped receiving means for receiving a fuel injection valve, wherein an inner surface of the sleeve-shaped receiving means conforms to and encloses a noise-reflecting surface of a nozzle end of the fuel injection valve to reduce a major portion of vibration emanating from the noise-reflecting surface.

2. Suction pipe apparatus according to claim 1, wherein the connecting pipe and the receiving means are formed from an elastomer.

3. Suction pipe apparatus according to claim 2, wherein a flange portion of the connecting pipe is provided with a stiffening member.

4. Suction pipe apparatus according to claim 2, wherein the elastomeric connecting pipe is integrally formed on the intake pipe by injection molding.

* * * * *